US009221095B2

(12) United States Patent
Sato et al.

(10) Patent No.: US 9,221,095 B2
(45) Date of Patent: Dec. 29, 2015

(54) MANUFACTURING METHOD FOR A BLADE MATERIAL

(75) Inventors: Koji Sato, Minato-ku (JP); Takashi Toga, Yasugi (JP); Yoshihiro Wakazono, Minato-ku (JP); Hideki Matsumoto, Yasugi (JP); Yusuke Shigihara, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 334 days.

(21) Appl. No.: 13/825,666

(22) PCT Filed: Sep. 22, 2011

(86) PCT No.: PCT/JP2011/071604

§ 371 (c)(1), (2), (4) Date: Mar. 22, 2013

(87) PCT Pub. No.: WO2012/043374

PCT Pub. Date: Apr. 5, 2012

(65) Prior Publication Data

US 2013/0298401 A1 Nov. 14, 2013

(30) Foreign Application Priority Data

Sep. 27, 2010 (JP) ..... 2010-215009

(51) Int. Cl.

| | |
|---|---|
| ***B21K 3/04*** | (2006.01) |
| ***B21D 53/78*** | (2006.01) |
| ***B21J 13/10*** | (2006.01) |
| ***B21D 53/92*** | (2006.01) |

(52) U.S. Cl.

CPC . *B21K 3/04* (2013.01); *B21D 53/78* (2013.01); *B21D 53/92* (2013.01); *B21J 13/10* (2013.01); *Y10T 29/49336* (2015.01); *Y10T 29/53996* (2015.01)

(58) Field of Classification Search

CPC ..... B21K 27/00; B21K 3/04; B21D 53/78; B21D 53/92; B21D 37/16; B21J 13/08; B21J 13/10; B21J 13/12; B21J 1/06; Y10T 29/53996; Y10T 29/49336; Y10T 29/49337; Y10T 29/49339

See application file for complete search history.

(56) References Cited

U.S. PATENT DOCUMENTS

| | | | | |
|---|---|---|---|---|
| 2,503,630 A | | 4/1950 | Norton | |
| 3,831,425 A | * | 8/1974 | Kita | 72/405.13 |
| 4,449,390 A | * | 5/1984 | Pontini | 72/405.09 |

FOREIGN PATENT DOCUMENTS

| | | |
|---|---|---|
| CN | 101342562 A | 1/2009 |
| JP | 58-205639 A | 11/1983 |

(Continued)

*Primary Examiner* — Sarang Afzali

(74) *Attorney, Agent, or Firm* — Sughrue Mion, PLLC

(57) ABSTRACT

Provided are a manufacturing method for a blade material and a manufacturing device for a blade material, by which a long blade material can be manufactured without using a large-sized press forging machine. A manufacturing method for a blade material, in which hot forging is sequentially performed by molds from the root side to a blade (vane) tip, wherein when a root-side portion is grasped and a material to be forged is restrained by a mold, twisting is performed on a region between the grasped portion and the restrained portion. A manufacturing method for a blade material, in which hot forging and twisting are repeated, is preferable, and a manufacturing method for a blade material, in which hot forging is performed while molds are sequentially changed, is more preferable.

6 Claims, 4 Drawing Sheets

(56) References Cited

FOREIGN PATENT DOCUMENTS

| | | | | | |
|---|---|---|---|---|---|
| JP | 62-192223 | A | | 8/1987 | |
| JP | 63-123456 | A | | 5/1988 | |
| JP | 63123546 | A | * | 5/1988 | ..... B21J 5/00 |
| JP | 63-241118 | A | | 10/1988 | |
| JP | 63-252635 | A | | 10/1988 | |
| JP | 1-127132 | A | | 5/1989 | |
| JP | 04004937 | A | * | 1/1992 | ..... B21J 13/10 |
| JP | 2-187232 | A | | 7/2014 | |

* cited by examiner

MANUFACTURING METHOD FOR A BLADE MATERIAL

CROSS REFERENCE TO RELATED APPLICATIONS

This application is a National Stage of International Application No. PCT/JP2011/071604 filed Sep. 22, 2011, the contents of which are incorporated herein by reference in their entirety.

TECHNICAL FIELD

The present invention relates to a method for manufacturing, by forging, a blade material in which a blade (vane) tip and a root are twisted with respect to each other, and also relates to a manufacturing device for manufacturing the blade material.

BACKGROUND ART

In recent years, in order to improve the efficiency of steam turbines, the length of the blade used for the steam turbines has also been increased. For example, when a long blade material having a length of over about 1500 mm is manufactured, a method is mainly used in which a material is sandwiched between an upper mold and a lower mold and is then formed into a blade material by a large press forging machine.

However, in the above-described method, since large working force of 10,000 tons or more is needed, an investment in equipment including the forging machine is very large, and also the manufacturing cost of the molds is very high.

On the other hand, methods for manufacturing a long blade material by using a forging machine having a relatively small capacity have also been tried. These methods are technically divided into two main categories. The first category includes methods, as represented by, for example, JP-A-62-192223 (Patent Literature 1) filed by the present applicants, in which methods the area to be forged is divided into a plurality of areas and then a blade material is formed by forging the divided areas. The second category includes methods, as represented by, for example, JP-A-63-241118 (Patent Literature 2), in which methods a semi-finished product is obtained by forging a material while maintaining a horizontal state of the material, and then a blade material is formed by twisting the semi-finished product.

CITATION LIST

Patent Literature

Patent Literature 1: JP-A-62-192223
Patent Literature 2: JP-A-63-241118

SUMMARY OF INVENTION

Technical Problem

In the method which is described in Patent Literature 1 and in which the area to be forged is divided and forged, even though the first area is forged and formed into a shape of a blade material, when the next area is forged, the previously forged area may be deformed due to the influence of stress caused by forging the next area.

Further, in the method in which a semi-finished product is twisted after the semi-finished product is manufactured, a portion which is most easily deformed is deformed at the time of twisting. Therefore, there also remains a problem in the accuracy of the shape of the product. Particularly, when the length of a blade is increased, it is difficult to precisely form the shape of the blade. Further, when a large distortion is locally applied to a long blade at normal temperature, and then when the long blade is annealed as it is, the hardness of the long blade may be locally reduced.

Because of the above-described reasons, particularly in the case of manufacture of a long blade material, it has been necessary to adopt a method in which a whole material to be forged is sandwiched between an upper and lower molds and is then formed into the blade material under application of high-load generated by a large press forging machine.

An object of the present invention is to provide a manufacturing method for a blade material, which method can manufacture a long blade without using a large press forging machine, and also to provide a manufacturing device for a blade material, in which device the manufacturing method is used.

Solution to Problem

The present invention has been made in view of the above-described problems.

That is, the present invention provides a manufacturing method of a blade material by sequentially hot-forging the material from a root side to a blade tip with a mold, wherein when the material to be forged is grasped in a portion on the root side and the material to be forged is restrained by the mold, a locally forged area between the grasped portion and the restrained portion is subjected to twisting processing.

Further, the manufacturing method of the blade material is configured such that the root side of the material to be forged is grasped by a manipulator, and such that the twisting processing is performed by rotating the material to be forged by the manipulator grasping the root side.

Further, the manufacturing method of the blade material, according to the present invention, is configured such that the hot-forging processing and the twisting processing are repeated.

Preferably, the manufacturing method of the blade material is configured such that the hot-forging processing is performed by sequentially changing molds.

More preferably, the manufacturing method of the blade material is configured such that the area previously subjected to hot-forging processing and the area subsequently subjected to hot-forging processing partially overlap with each other.

More preferably, the manufacturing method of the blade material is configured such that the local forging processing and the twisting processing are performed in the state where the blade tip to be hot-forged is placed in a heating furnace.

More preferably, the manufacturing method of the blade material is configured such that the material to be forged, which is grasped by the manipulator, is forged while being pulled out from the heating furnace by the manipulator.

Further, the material to be forged, which is used in the manufacturing method of the blade material according to the present invention, has a circular lateral cross section, or a rectangular cross section, and has a shape corresponding to expansion and contraction of a final product shape.

Further, the present invention provides a manufacturing device of a blade material, the manufacturing device including: a forging device provided with a function of locally forging, with a mold, a predetermined area of a material to be forged, and a function of restraining the material to be forged by the mold; and a manipulator provided with a movement function of adjusting the position of the to-be-forged area of the material to be forged, in order that the material to be forged is hot-forged sequentially from a root side to a blade tip of the material to be forged, a function of grasping the material to be forged, and a function of applying twisting processing to the locally forged area between the grasped portion and the portion restrained by the mold, by twisting the material to be forged when the material to be forged is restrained by the forging device.

Preferably, in the manufacturing device of the blade material, the forging device includes a function of sequentially changing the molds for forming the material to be forged.

More preferably, the manufacturing device of the blade material further includes a heating device for heating the material to be forged.

Preferably, in the manufacturing device of the blade material, the root side of the material to be forged is grasped by the manipulator, and the material to be forged is forged while being pulled out from the heating furnace by the manipulator.

Further, the manufacturing device of the blade material, according to the present invention, may further include a descaling device for removing oxide scale formed on the material to be forged pulled out from the heating furnace.

Advantageous Effects of Invention

With the present invention, it is possible to manufacture a long blade material without using a large press forging machine.

DESCRIPTION OF EMBODIMENTS

As described above, an important feature of the present invention is that, when a root-side portion of a material to be forged into a blade material is grasped, and also when a portion of the material is restrained by a forging mold, twisting processing is applied to an area between the grasped portion and the restrained portion.

A manufacturing method of a blade material according to the present invention will be described in detail by using an example and with reference to the accompanying drawings. However, the present invention is not limited to the embodiments described herein, and various combinations and modifications are possible within the scope and spirit of the present invention.

Figure 7:
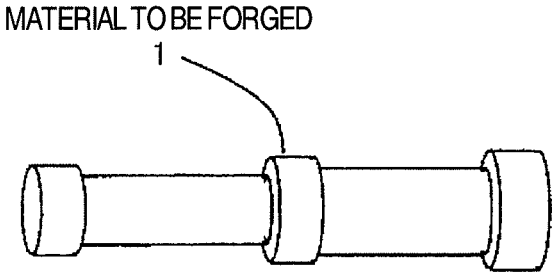
FIG. 7 is a schematic view showing an example of a material to be forged (raw material).
Figure 8:
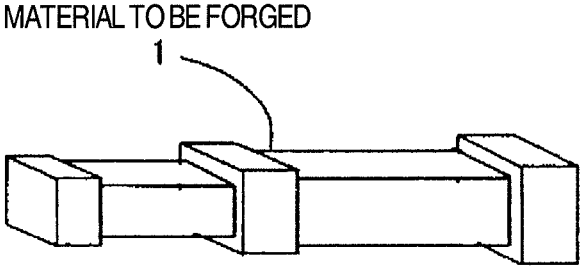
FIG. 8 is a schematic view showing an example of a material to be forged (raw material).

First, a material (raw material) to be forged into a blade material is prepared. It is preferred to prepare and use a material 1 to be forged which has a circular lateral cross-sectional shape as shown in FIG. 7 or has a rectangular lateral cross sectional shape as shown in FIG. 8. For example, when a material to be forged which has a circular lateral cross-sectional shape is used, a mold for forging a part of the material can be easily positioned. Further, when a material to be forged which has a rectangular lateral cross-sectional shape is used, the contact area between the mold and the material to be forged can be easily increased at the time of forging, and thereby the direction of the flow of the material to be forged can be easily controlled in the longitudinal direction and the width direction at the time of forging, so that the shape of a blade material can be easily controlled. Any of the materials having such lateral cross-sectional shapes may be used, but a material to be forged (raw material) which has a rectangular lateral cross-sectional shape and a large contact area is more preferred in view of controlling the shape of a final product (blade material).

Further, it is preferred that, as shown in FIG. 7 and FIG. 8, a material to be forged (raw material) processed into the above-described blade material has a shape corresponding to expansion and contraction of the shape of a final product (blade material). Specific examples of the shape corresponding to the expansion and contraction of a final product (blade material) are described as follows: for example, in the case where a blade material is thick at the root-side thereof and is thin at the blade tip thereof, the shape of the material to be forged can be formed into the shape corresponding to the shape of the final product by also changing the shape of a material to be forged (raw material) so as to increase the root side thickness of the material and to reduce the blade tip side thickness of the material. Further, for example, in the case where the shape of a final product is the shape of a blade material 9 having a boss portion 10 at the center thereof as shown in FIG. 6, the shape of the material to be forged can be formed into a shape corresponding to the shape of the final product by forming the shape of a material to be forged (raw material) so as to increase the longitudinal cross-sectional area of the material at the position corresponding to the boss portion.

Figure 6:
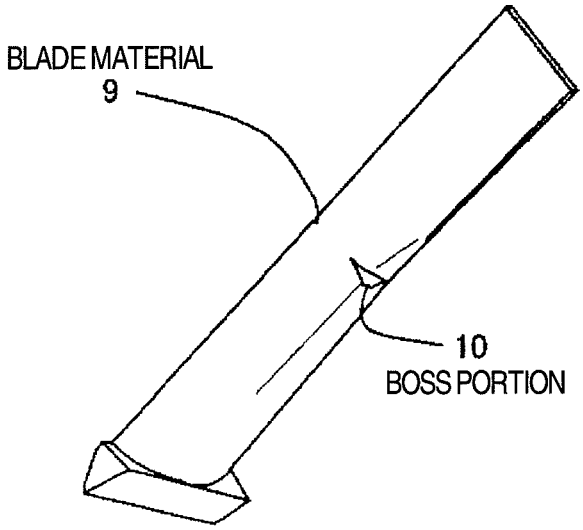
FIG. 6 is a schematic view showing an example of a blade material manufactured according to the present invention.

According to the present invention, a material to be forged is sequentially forged and twisted in a hot manufacturing process, so as to be eventually formed into the blade material 9 having the shape as shown in FIG. 6. For this reason, the material to be forged needs to be heated before being subjected to hot-forging. It is preferred that a heating furnace for heating the material to be forged is installed at a place as close to a forging device as possible so as to suppress a decrease in the temperature of the material to be forged. For example, it is preferred that the material 1 to be forged is inserted into a heating furnace 4 arranged at a position adjacent to the forging device as shown in FIG. 1 and FIG. 2, and is heated and held at a predetermined temperature.

Figure 1:
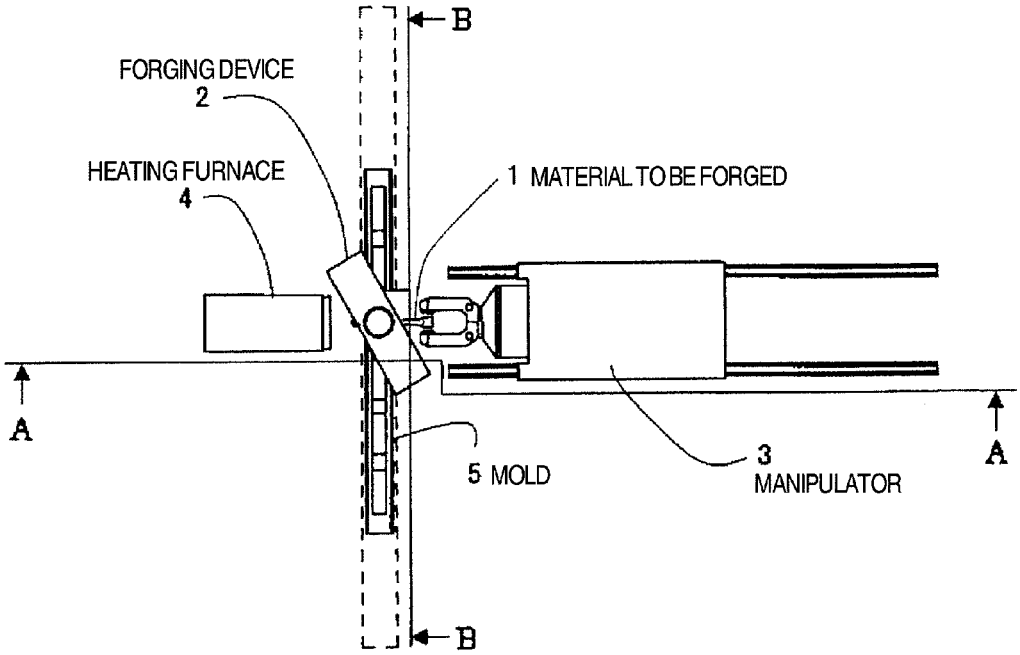
FIG. 1 is a schematic view showing an example of a forging device according to the present invention.

Further, as for the arrangement of a manufacturing device of a blade material, it is preferred that, as shown in FIG. 1, the heating furnace 4 for heating the material 1 to be forged is installed on the opposite side of a manipulator with reference to the forging device. Especially, in the case where, as shown in FIG. 1 and FIG. 2, the heating furnace 4 and the forging device 2 are arranged close to each other and in a line together with the manipulator 3, the material to be forged can be forged while being pulled out from the heating furnace by the manipulator grasping the root side of the material to be forged. Thereby, the material to be forged can be forged into a desired shape immediately after being taken out from the heating device. When the forging device and the heating furnace are arranged in a line and close to each other, the material to be forged can be heated until just before being forged. Further, since the blade tip of the material to be forged, which blade tip is an unformed portion, is placed in the heating furnace, and the unformed portion can be heated until just before being hot-forged, a decrease in the temperature of the material to be forged can be prevented. As a result, by heating the material to be forged until just before the material is locally forged, the workability of the material to be forged is maintained in a good state.

Figure 2:
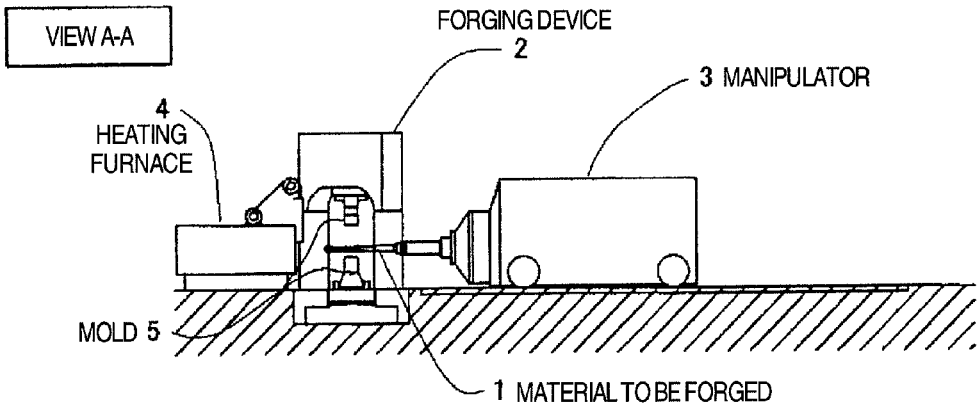
FIG. 2 is a schematic view showing the example of the forging device according to the present invention.

Note that, when a plurality of materials to be forged are hot-forged, the materials to be forged may be preheated, for example, by using another heating furnace in addition to the heating furnace 4 shown in FIG. 1 and FIG. 2. Thereby, it is possible to improve the productivity by suppressing a decrease in the temperature in the heating furnace due to insertion of a new material to be forged into the heating furnace.

Figure 4:
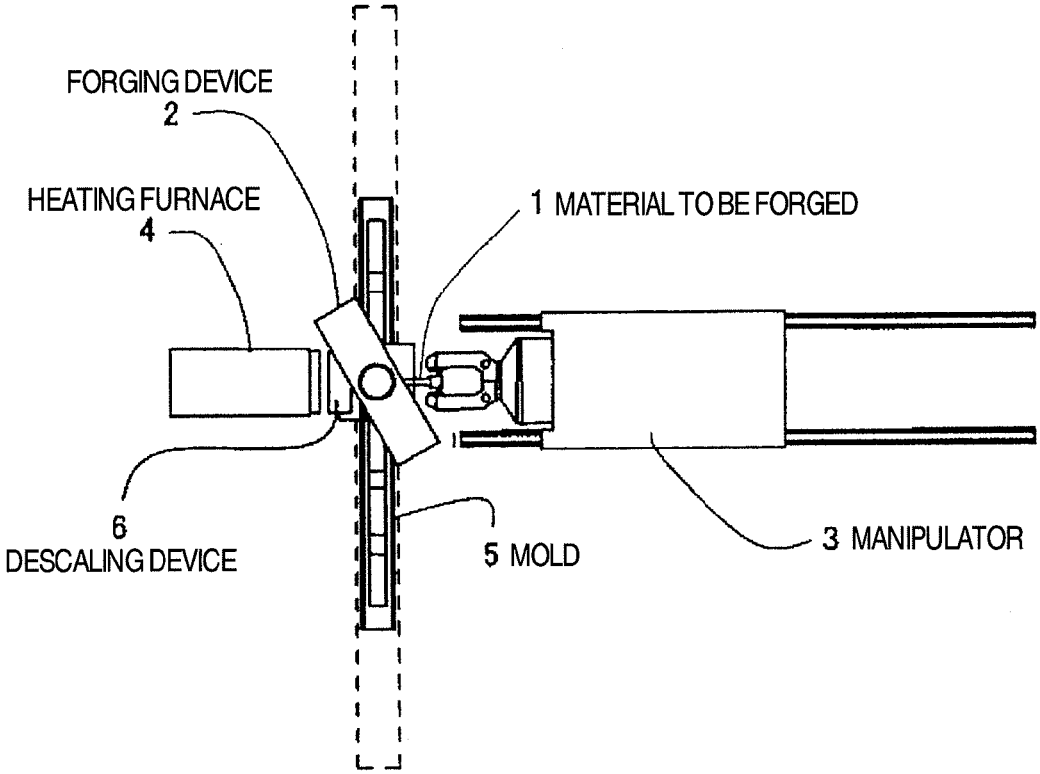
FIG. 4 is a schematic view showing an example of a forging device according to the present invention.

Further, when oxide scale is formed on the surface of the material to be forged by heating the material to be forged, the damage of the mold may be increased by the oxide scale at the time of forging. Therefore, the oxide scale may be removed by providing a descaling device 6 as shown in FIG. 4. As the descaling device 6, it is possible to use, for example, a device for spraying atomized water or the like, toward the material to be forged taken out from the heating furnace 4.

The forging device 2 according to the present invention includes a function of locally forging the material 1 to be forged, and a function of restraining the material to be forged. Further, the forging device 2 includes a plurality of molds 5 which are used for forming the material 1 to be forged into a predetermined shape. In the present invention, a pair of upper and lower molds are used so that the material to be forged can be formed into the predetermined shape by being pressed by the forging device. At this time, it is desirable to adjust the mold so that the material to be forged can be forged horizontally.

Figure 3:
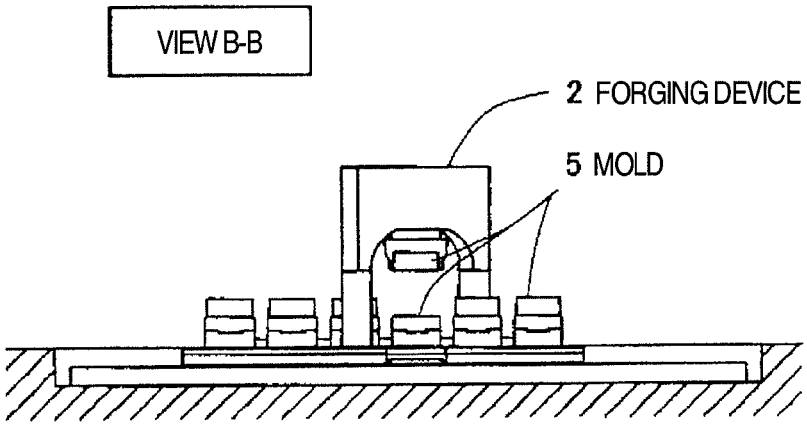
FIG. 3 is a schematic view showing the example of the forging device according to the present invention.

Note that the plurality of molds 5 arranged in a line are shown in FIGS. 1 to 3. In this case, a plurality of the pairs of molds 5 are arranged in a line so that each of portions of the material to be forged can be sequentially forged by each of the pair of molds 5. When the molds are arranged in a line, it is possible to reduce the time to change one pair of molds to another pair of the molds to be used for the next process of forging and twisting, after one process of forging and twisting is ended. When the time required to change the molds is increased, the temperature of material to be forged is decreased, so that the workability of the material to be forged is deteriorated. Due to the deterioration of the workability of the material to be forged, it becomes difficult to perform the process of forging and twisting, and also it may become difficult to control, for example, the metal texture of the material to be forged and the hardness of the material in the heat treatment subsequently performed. For this reason, it is preferred that the molds to be used for working the material to be forged are arranged so as to be easily changed.

When the hot forging according to the present invention is performed, the root portion of the material also needs to be formed in order that the material to be forged is formed into, for example, a blade material 9 having a shape as shown in FIG. 6. The root of the material to be forged may be formed by the forging device according to the present invention shown in FIG. 1, but a material in which only a root 7 is formed beforehand by another forging device may also be used as the material to be forged.

The manipulator 3 used in the present invention has a function of twisting the material to be forged, as well as a function of grasping the material to be forged. Further, the manipulator has a function of grasping the root side of the material to be forged and moving the material to the position where subsequent local forging is performed. Note that the manipulator, of course, has functions of performing travelling, traversing, tilting operations and the like, which are provided for a common manipulator.

Figure 5:
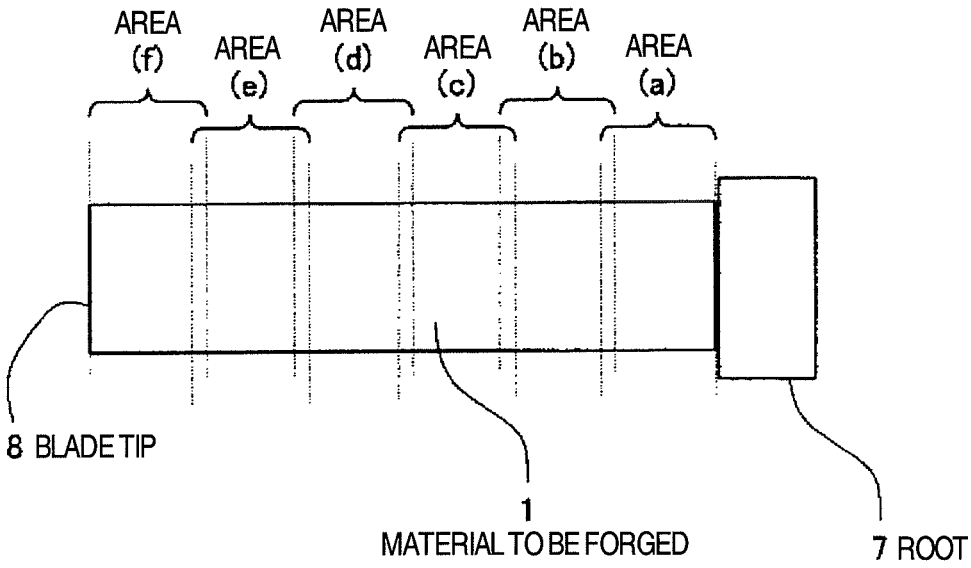
FIG. 5 is a schematic view showing portions of a material to be forged, which portions are sequentially forged.

In the present invention, the root side (including the root) of the material to be forged is grasped by the manipulator, and a to-be-forged portion of the material is suitably positioned. For example, as shown in FIG. 5, when the portions from the area (a) to the area (0 of the material 1 to be forged are to be sequentially forged, the root 7 is grasped by the manipulator, and the area (a) is moved to the position at which the area (a) can be formed by the molds provided in the forging device.

Then, the area (a) is locally forged, so that the shape of the area (a) is formed. After the shape of the area (a) is formed, the molds are then changed to the molds for forming the area (b) so as to enable the area (b) to be locally forged, and also the manipulator is moved to the position at which the area (b) can be locally forged.

It is preferred that, at this time, the to-be-forged area (b) is adjusted so that the area (a) and the area (b) partially overlap each other. This is because, if the area (a) and the area (b) are not made to overlap with each other, a non-forged portion may be left at the boundary portion between the area (a) and the area (b).

Next, the area (b) is locally forged. After the area (b) is locally forged and thereby the shape of the area (b) is formed, the material 1 is twisted by slightly rotating the manipulator so that the material 1 is formed into the shape of the blade material shown in FIG. 6. The portion subjected to the twisting processing is the area between the root 7 grasped by the manipulator and the area (b) restrained and fixed by the molds. In this case, the portion subjected to the twisting processing is the area (a).

The area (a) subjected to the twisting processing is the locally forged area. In this case, the area (a) is recuperated by the forging processing, and hence can be subjected to the twisting processing in the state where the good workability of the material is maintained.

When the twisting processing is ended, the restraint of the area (b) is released. Then, in order to enable the area (c) to be locally forged in the next process, the molds are changed to the molds for forming the area (c), and also the manipulator is moved to the position at which the area (c) can be locally forged.

Also, at this time, it is preferred that the area (c) is formed so that the area (b) and the area (c) partially overlap each other. When, after the twisting processing, the overlapping portion between the locally forged area and the area to be locally forged is secured, not only the above-described non-forged portion can be prevented from being left, but also the shape of the area (c) can be formed together with the shape of the portion of the twisted area (b) which portion is located on the side of the area (c). Therefore, it is preferred that the overlapping area to be locally forged is suitably changed according to the size of the area subjected to the twisting processing.

Next, the area (c) is locally forged. After the area (c) is locally forged and thereby the shape of the area (c) is formed, twisting processing is applied to the material 1 to be forged by slightly rotating the manipulator so that the material 1 is formed into the shape of the blade material shown in FIG. 6. The portion subjected to the twisting processing is the area between the root 7 grasped by the manipulator and the area (c) restrained and fixed by the molds. In this case, the portion subjected to the twisting processing corresponds to the portion from the area (a) to the area (b), and hence the distance between the portion grasped by the manipulator and the portion restrained by the molds becomes long. When the distance of the portion from the area (a) to the area (b) becomes long and thereby the shape of the portion is made difficult to be formed, the fixation on the side of the manipulator may be once released so that the grasping position by the manipulator is changed to allow, for example, the area (a) to be held by the manipulator. In any case, the portion grasped by the manipulator is located on the root side from the area restrained by the molds.

The material 1 to be forged can be formed into the blade material 9 by repeating the local forging processing and the twisting processing, as described above, so as to forge the portions from the area (a) to the area (f) of the blade tip 8.

With the manufacturing method according to the present invention, the locally forged area of the material to be forged can be twisted during hot forging processing and/or immediately after the local hot forging processing is ended. For this reason, the material to be forged can be maintained at a high temperature state by recuperation during the hot forging processing. Therefore, the workability of the material is high, and hence the material can be easily twisted.

Further, since the subsequent forging and twisting processing can be continuously performed with the portion formed by the forging processing or the root of the material to be forged being pulled out by the manipulator as it is, the manufacturing method according to the present invention is excellent in productivity. Note that the forging processing referred to in the present invention also includes so-called press-forging processing.

With the present invention, it is possible to manufacture a long blade material without using a large press forging machine. In particular, when the workability of a material to be forged is taken into account, the present invention can be effectively applied to ferritic heat-resistant steel described in JIS G 0203.

| Reference Signs List | |
|---|---|
| 1 | Material to be forged |
| 2 | Forging device |
| 3 | Manipulator |
| 4 | Heating furnace |
| 5 | Mold |

-continued

| Reference Signs List | |
|---|---|
| 6 | Descaling device |
| 7 | Root |
| 8 | Blade tip |
| 9 | Blade material |
| 10 | Boss portion |

The invention claimed is:

1. A manufacturing method of a blade material by sequentially processing a local hot-forging of the material from a root side to a blade tip with a mold, wherein after the material to be forged is grasped in a portion on the root side and the local hot-forging is processed, while the material to be forged is restrained by the mold, a locally forged area between the grasped portion in the portion on the root side and the restrained portion by the mold is subjected to twisting processing, wherein an area previously subjected to hot-forging processing and an area subsequently subjected to hot-forging processing partially overlap with each other, wherein the material to be forged grasped by a manipulator is forged while being pulled out from a heating furnace by the manipulator.

2. The manufacturing method of the blade material according to claim 1, wherein the root side of the material to be forged is grasped by a manipulator, and the twisting processing is performed by twisting the material to be forged by the manipulator grasping the root side.

3. The manufacturing method of the blade material according to claim 1, wherein the hot-forging processing and the twisting processing are repeated.

4. The manufacturing method of the blade material according to claim 1, wherein the hot-forging processing is performed by sequentially changing the molds.

5. The manufacturing method of the blade material according to claim 1, wherein the material to be forged has a circular lateral cross section and has a shape corresponding to expansion and contraction of a final product shape.

6. The manufacturing method of the blade material according to claim 1, wherein the material to be forged has a rectangular lateral cross section and has a shape corresponding to expansion and contraction of a final product shape.

* * * * *